US008705789B2

(12) United States Patent
Chen

(10) Patent No.: US 8,705,789 B2
(45) Date of Patent: Apr. 22, 2014

(54) MAGNET-LESS LOUDSPEAKER

(76) Inventor: Lu-Cheng Chen, Taipei (TW)

( * ) Notice: Subject to any disclaimer, the term of this patent is extended or adjusted under 35 U.S.C. 154(b) by 0 days.

(21) Appl. No.: 13/422,954

(22) Filed: Mar. 16, 2012

(65) Prior Publication Data

US 2013/0188822 A1 Jul. 25, 2013

(30) Foreign Application Priority Data

Jan. 20, 2012 (TW) ..... 101102556 A

(51) Int. Cl.
*H04R 13/00* (2006.01)

(52) U.S. Cl.
USPC ..... 381/419; 381/412; 381/396

(58) Field of Classification Search
USPC ..... 381/62, 77, 177, 189, 312, 361, 396, 381/400, 401, 406, 412, 417–420, 432, 421, 381/422
See application file for complete search history.

(56) References Cited

U.S. PATENT DOCUMENTS

| | | | | |
|---|---|---|---|---|
| 5,487,114 | A * | 1/1996 | Dinh | 381/406 |
| 7,577,269 | B2 * | 8/2009 | Adelman | 381/417 |
| 8,139,814 | B2 * | 3/2012 | Rottenberg et al. | 381/412 |

* cited by examiner

*Primary Examiner* — Curtis Kuntz
*Assistant Examiner* — Joshua A Kaufman
(74) *Attorney, Agent, or Firm* — Li & Cai Intellectual Property (USA) Office

(57) ABSTRACT

A loudspeaker, which includes a ferrite core, a voice coil, and a movable membrane. The voice coil is wound around the core and cooperatively defining an exciting device. The movable membrane is disposed in close proximity to the exciting device with a gap formed thereinbetween. The loudspeaker is constructed without permanent magnets.

11 Claims, 10 Drawing Sheets

MAGNET-LESS LOUDSPEAKER

BACKGROUND OF THE INVENTION

1. Field of the Invention

The instant disclosure relates to a loudspeaker; more particularly, to a loudspeaker constructed without permanent magnet.

2. Description of Related Art

With the advance in technology, electronic devices are becoming more miniaturized. Some examples of miniaturized devices are radios, portable cassette players, MP3 players, mobile phones, personal digital assistants (PDAs), and laptop computers.

To not disturb others while using abovementioned devices for listening purposes, earphones are used accordingly. Loudspeakers are used to produce sound and play a critical role for various electronic devices. Conventional loudspeakers include a voice coil that sits in front of a permanent magnet. When the electric signals are fed into the coil, the coil either attracts or repels the permanent magnet. The backward and forward movement of the voice coil pulls and pushes a movable membrane. The vibrating movable membrane thus pumps sounds out into the air.

However, the permanent magnet adds more cost to manufacture the loudspeakers, besides occupies additional space inside thereof. In other words, the sheer size and weight of the permanent magnet pose significant challenges in miniaturizing electron devices using conventional loudspeakers. Moreover, the permanent magnet is restricted to have circular shape, which narrows the use of conventional loudspeakers.

SUMMARY OF THE INVENTION

The object of the instant disclosure is to provide a magnet-less loudspeaker that occupies less space.

Another object of the instant disclosure is to provide a magnet-less loudspeaker, which is not restrict in shape and has a broader application range.

A further object of the instant disclosure is to provide a loudspeaker having simplified structures and is easy to assemble.

To achieve the abovementioned objects, the loudspeaker of the instant disclosure comprises: a ferrite core; a voice coil wound around the core and cooperatively forming an exciting device (i.e., electromagnet); and a movable membrane disposed in close proximity to the exciting device with a gap formed thereinbetween.

For advantages, the magnet-less loudspeaker of the instant disclosure is more cost-effective and takes up less space. These attributes are in accordance with the principle of providing light weight and miniaturized electronic devices.

In addition, the magnet-less loudspeaker can be circular, rectangular, or any other desired shape without restriction. Thus, the loudspeaker can be used more broadly in different electronic devices.

Moreover, the magnet-less loudspeaker is constructed with fewer components and easier to assemble. Particularly, the magnet-less loudspeaker is well suited for use in automated manufacturing process while increasing the yield rate.

In order to further appreciate the characteristics and technical contents of the instant disclosure, references are hereunder made to the detailed descriptions and appended drawings in connection with the instant disclosure. However, the appended drawings are merely shown for exemplary purposes, rather than being used to restrict the scope of the instant disclosure.

DETAILED DESCRIPTION OF EMBODIMENTS

[First Embodiment]

Figure 1:
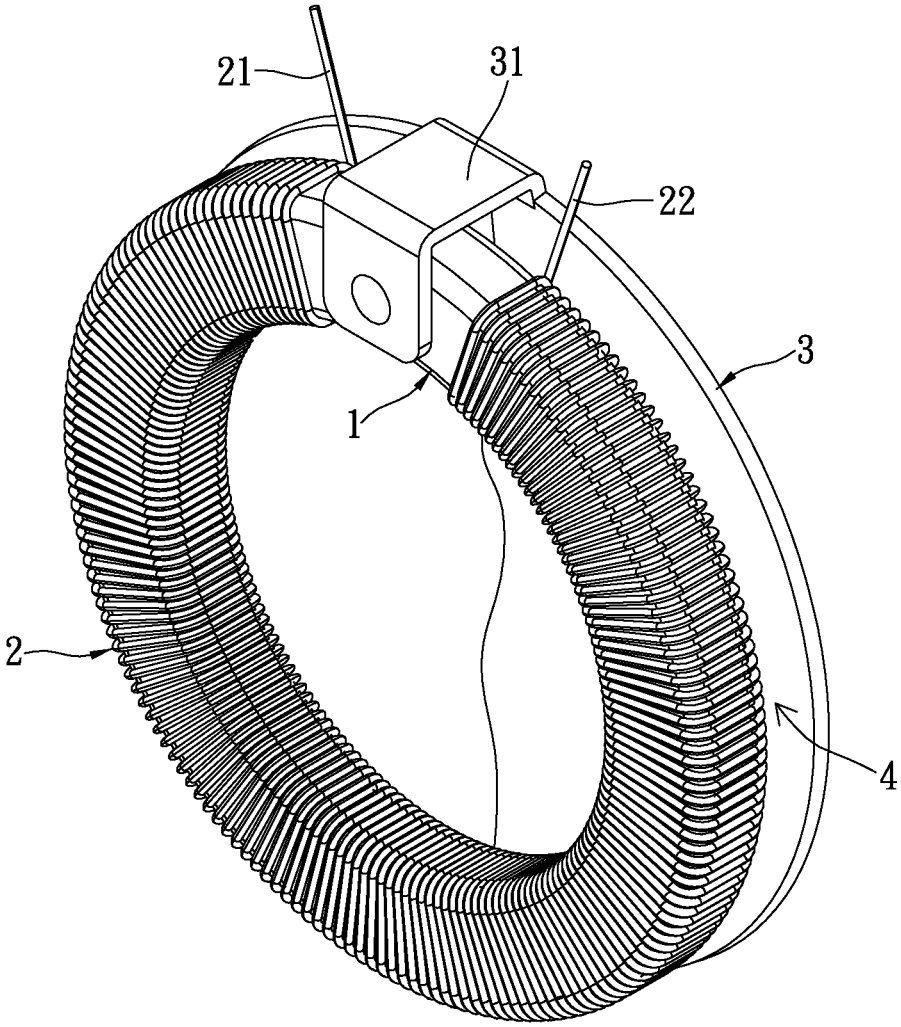
FIG. 1 is a perspective view showing a loudspeaker for a first embodiment of the instant disclosure.
Figure 2:
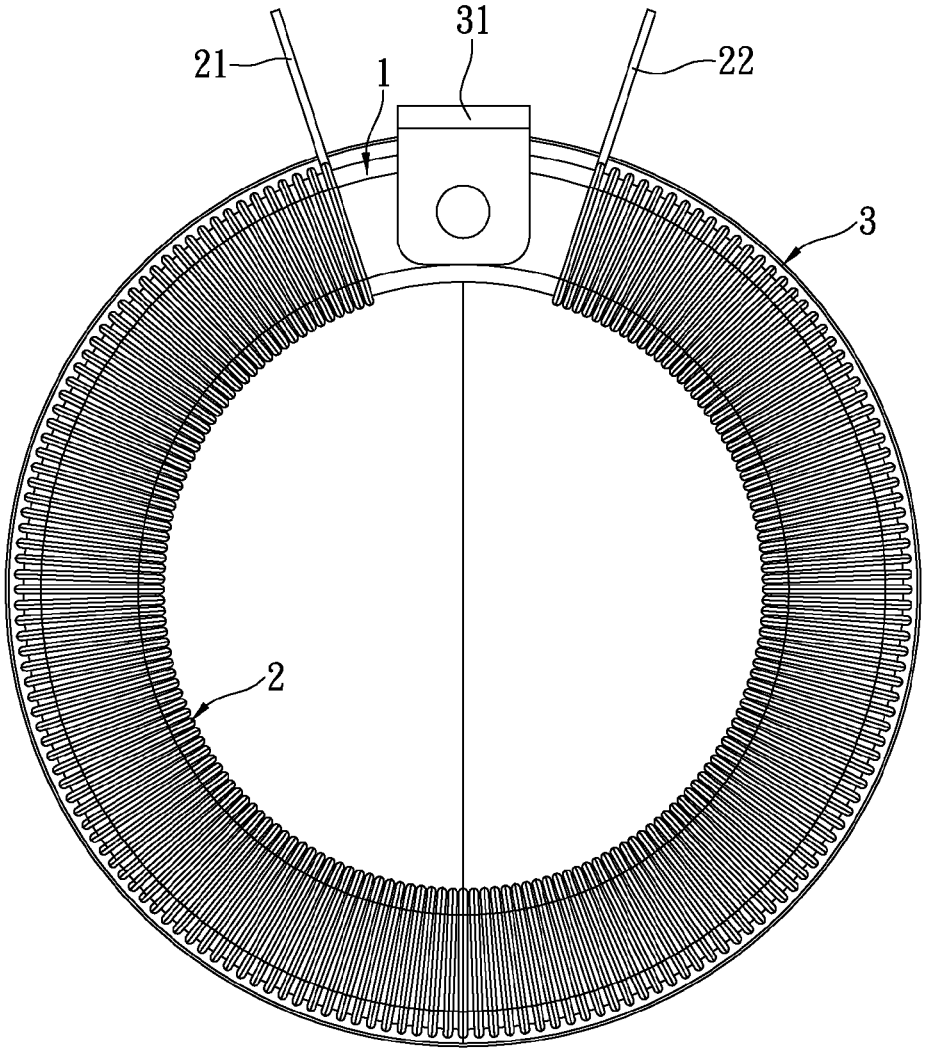
FIG. 2 is a front view of the loudspeaker in FIG. 1.
Figure 3:
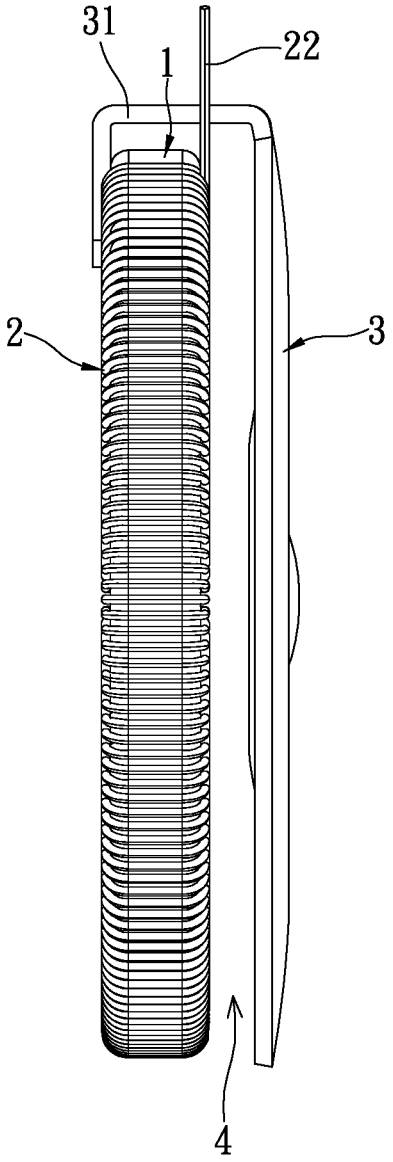
FIG. 3 is a side view of the loudspeaker in FIG. 1.

Please refer to FIGS. 1~3, which show a loudspeaker for a first embodiment of the instant disclosure. The loudspeaker is usable in earphones, sound boxes, and various electronic devices. The loudspeaker comprises a ferrite core 1, a voice coil 2, and a movable membrane 3. The core 1 is made of silicon steel strip or stamped powder. The shape of the core 1 is not restricted, which may be circular, rectangular, or any other desired shape. The exact structural configuration and shape of the core 1 shall depend on specific operational requirement or practical needs and not be limited to the exemplary embodiments provided herein. For the instant embodiment, the core 1 has an annular body.

The voice coil 2 is wound around the core 1. The opposite ends of the voice coil 2 form a pair of leads 21 and 22 for connecting to a circuit unit (not shown). Thus, electrical current can be fed into the voice coil 2. By winding the voice coil 2 around the annular core 1, the core 1 and the voice coil 2 cooperatively define an exciting device (i.e., electromagnet).

The movable membrane 3 has a plate-like body made from a metallic material such as iron. The material and thickness of the movable membrane 3 are not restricted. However, the movable membrane 3 is preferably made of a material having a high degree of magnetic susceptibility. The shape of the movable membrane 3 may correspond to the shape of the core 1. For the instant embodiment, the movable membrane 3 has a circular plate-like body corresponding to the annular core 1. The movable membrane 3 may also be wave-shaped. The movable membrane 3 is disposed in close proximity to the exciting device, where a gap 4 is formed thereinbetween. The width of the gap 4 is not restricted. In other words, the material and thickness of the movable membrane 3 and the width of the gap 4 shall depend on specific operational requirement or practical needs. Thus, the loudspeaker can produce sound having different audio tones. Furthermore, the movable membrane 3 can be magnetically polarized in becoming a magnetized element.

In addition, the movable membrane 3 can be connected to the core 1. Thus, a module is defined cooperatively by the core 1, the voice coil 2, and the movable membrane 3. For the instant embodiment, the loudspeaker has a connecting member 31 abridging the movable membrane 3 to the core 1. More specifically, one end of the connecting member 31 bendingly extends from the edge portion of the movable membrane 3.

Whereas the other end of the connecting member 31 is riveted, recessed, or screwed to the core 1. Thus, the movable membrane 3 is abridged to the core 1. Even if the movable membrane 3 is not abridged to the core 1, the movable membrane 3 can be affixed to a housing or any suitable holding member (not shown).

To use the loudspeaker, electrical currents are fed into the voice coil 2. Thus, a magnetic field is produced by the exciting device. By repelling or attracting the movable membrane 3, the movable membrane 3 moves forward and backward. The vibrating movable membrane 3 thus pumps sound waves into the air.

[Second Embodiment]

Figure 4:
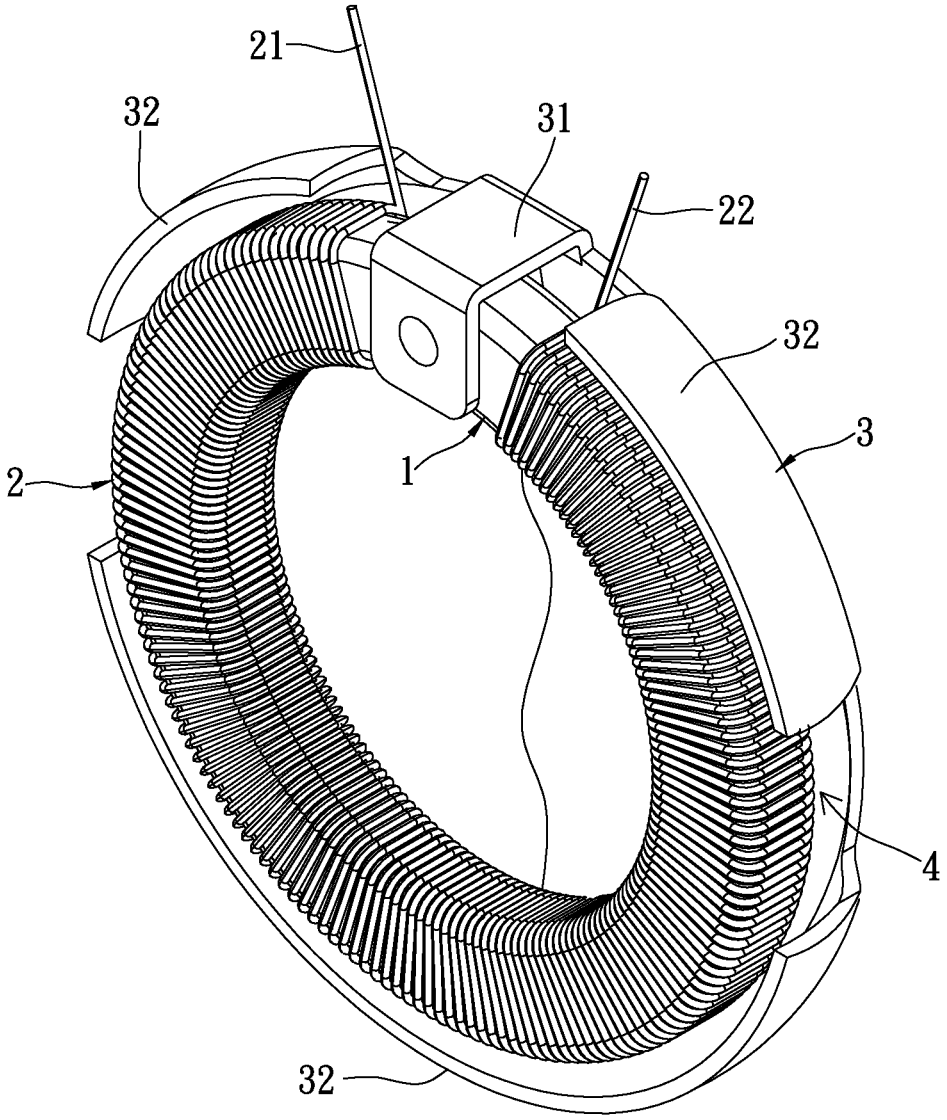
FIG. 4 is a perspective view showing a loudspeaker for a second embodiment of the instant disclosure.
Figure 5:
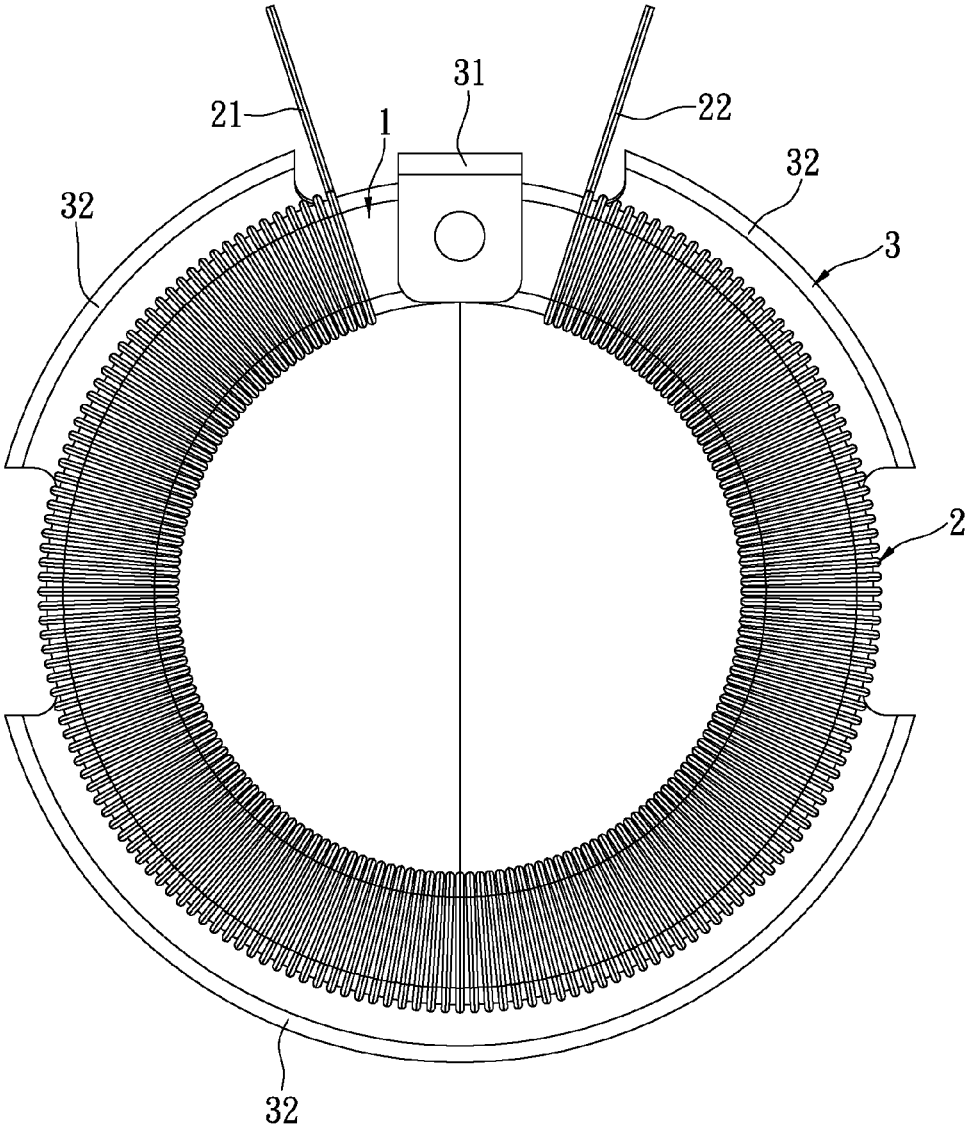
FIG. 5 is a front view of the loudspeaker in FIG. 4.
Figure 6:
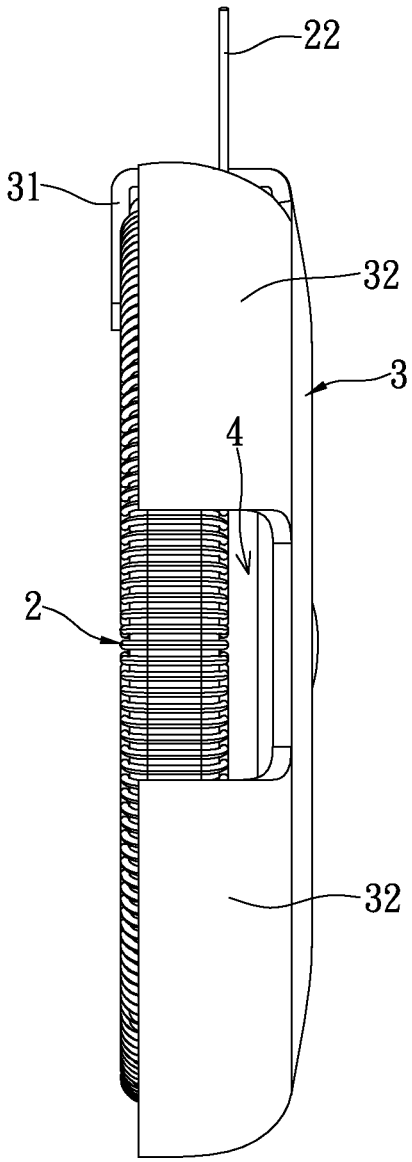
FIG. 6 is a side view of the loudspeaker in FIG. 4.

Please refer to FIGS. 4~6, which show a loudspeaker for a second embodiment of the instant disclosure. For the instant embodiment, the loudspeaker further has at least one covering member 32 bendingly extends from the edge of the movable membrane 3. As shown in the figures, the loudspeaker has three covering members 32, and each covering member 32 is arc-shaped. However, the exact structural configuration and shape of the covering member 32 shall depend on specific operational requirement or practical needs and not be limited to the exemplary embodiment provided herein. The covering members 32 are disposed around the periphery of the exciting device to concentrate the magnetic field.

[Third Embodiment]

Figure 7:
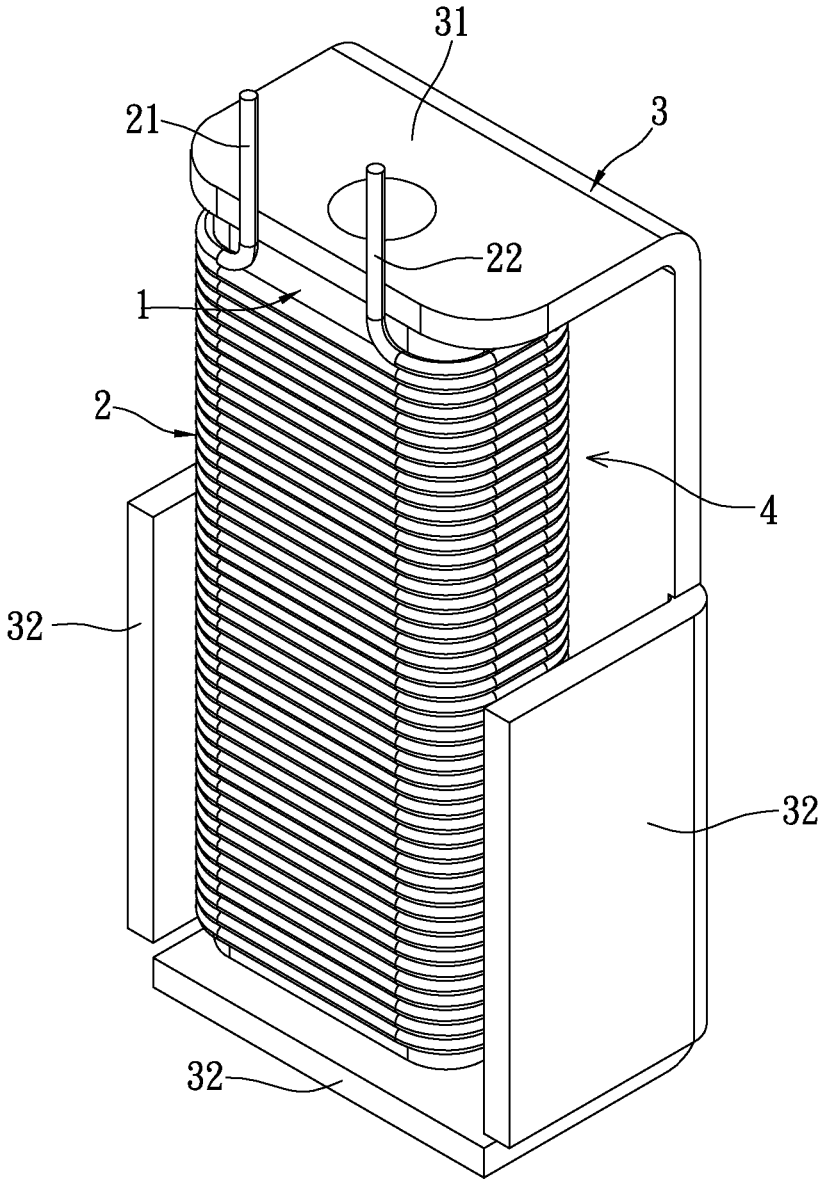
FIG. 7 is a perspective view showing a loudspeaker for a third embodiment of the instant disclosure.
Figure 8:
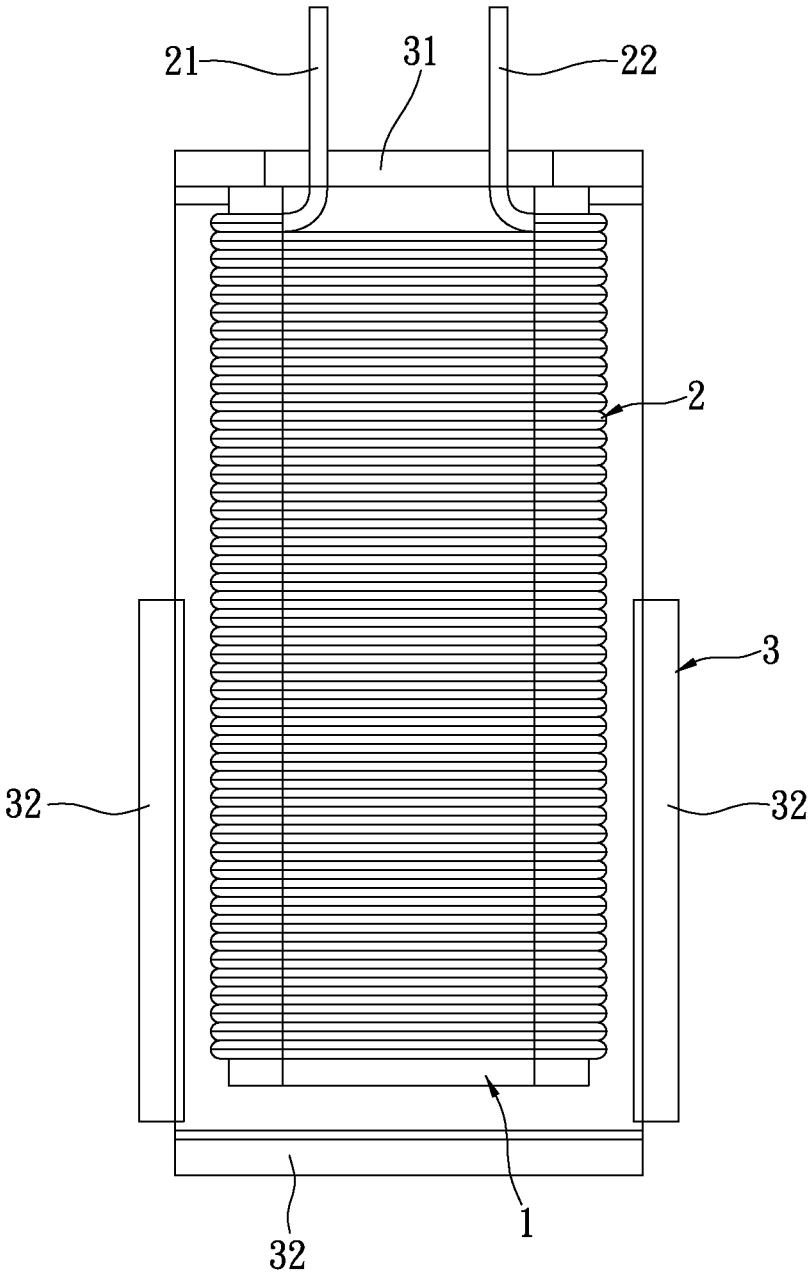
FIG. 8 is a front view of the loudspeaker in FIG. 7.
Figure 9:
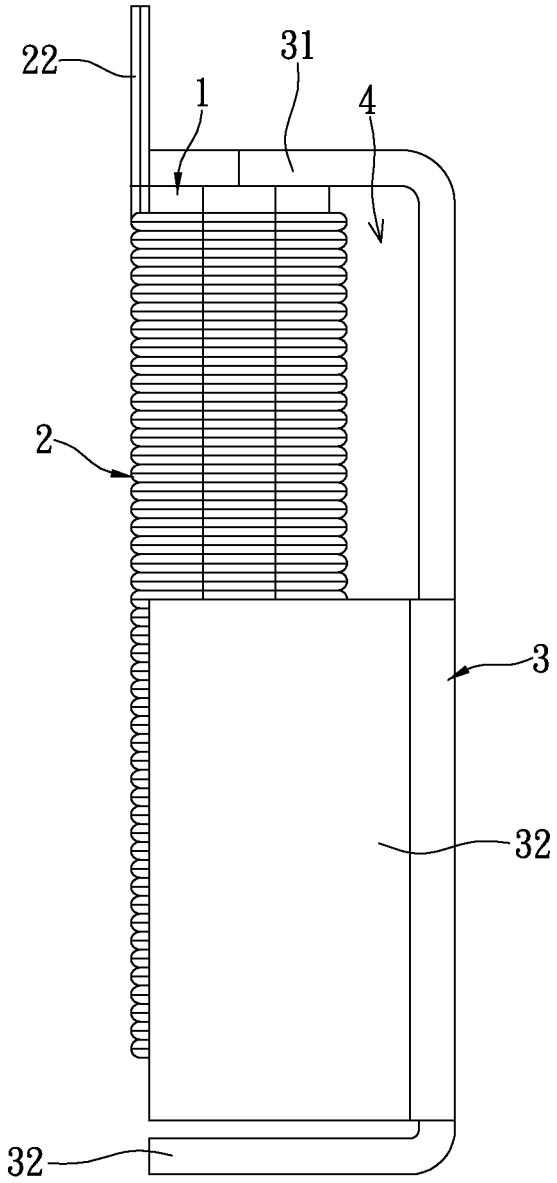
FIG. 9 is a side view of the loudspeaker in FIG. 7.

Please refer to FIGS. 7~9, which show a loudspeaker for a third embodiment of the instant disclosure. For the instant embodiment, the core 1 is a rectangular block with the voice coil 2 wound around thereof. Thereby, the formed exciting device is also substantially rectangular shaped. The movable membrane 3 has a rectangular plate-like shape, where a plurality of covering members 32 is bendingly extended from the edge thereof. The covering members 32 are disposed in close proximity to the exciting device to concentrate the magnetic field.

[Fourth Embodiment]

Figure 10:
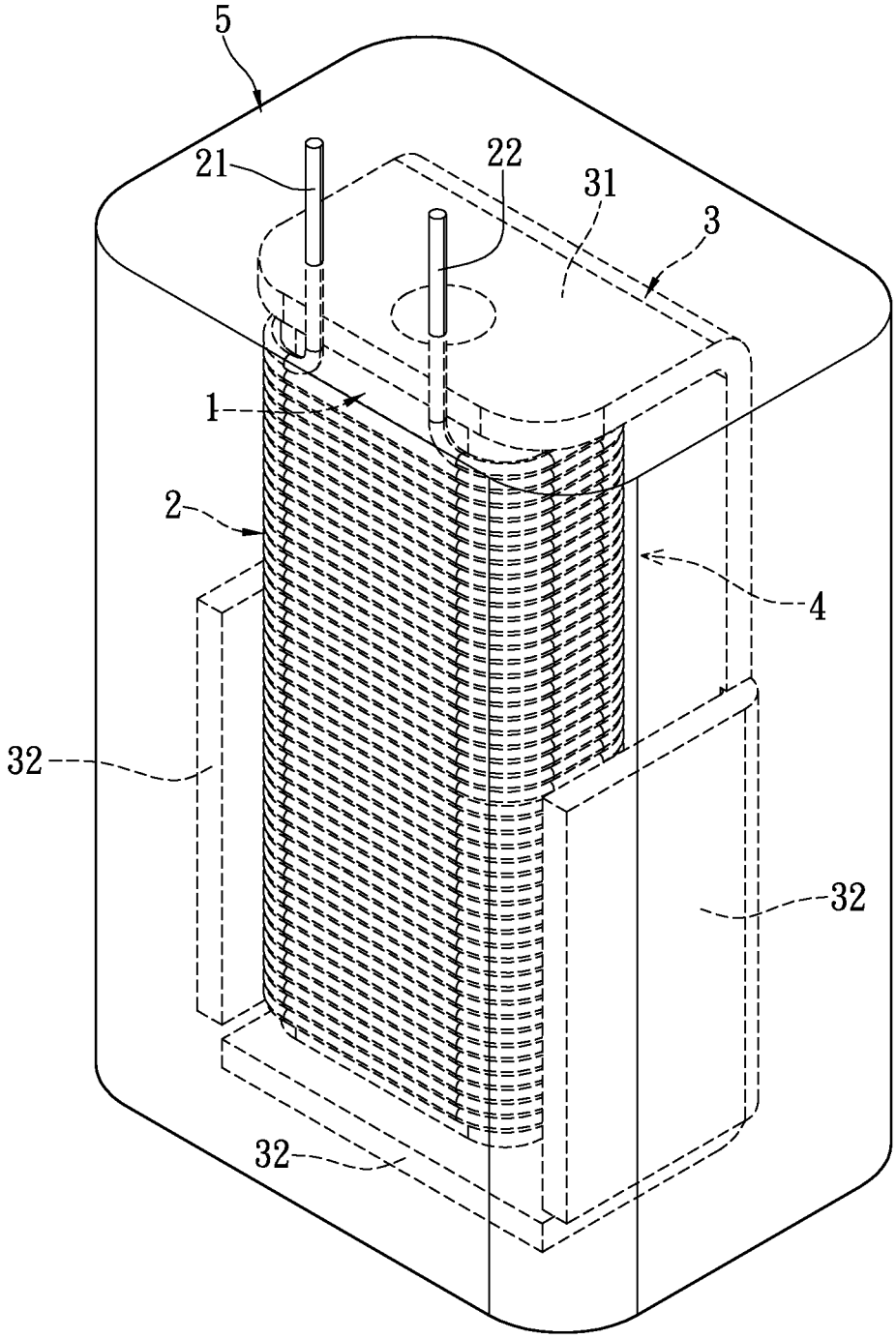
FIG. 10 is a perspective view showing a loudspeaker for a fourth embodiment of the instant disclosure.

Please refer to FIG. 10, which shows a loudspeaker for a fourth embodiment of the instant disclosure. For the instant embodiment, the core 1, the voice coil 2, and the movable membrane 3 are further enclosed by a housing 5. Thus, an acoustic chamber is formed to enhance the sound quality. At least one sound output port (not shown) is formed on the housing 5.

The magnet-less loudspeaker of the instant disclosure is more cost-effective and having reduced size. The reduction in size is particularly advantageous for applications in which weight minimization and size miniaturization are important. Furthermore, in the absence of the permanent magnet, the loudspeaker may be circular, rectangular, or any other desired shape. Thus, the loudspeaker can have a broader application range. Moreover, the loudspeaker comprises the core, the voice coil, and the movable membrane. With fewer components, the loudspeaker has a simplified structure and is easier to assemble. These attributes are particularly well suited for use in automated manufacturing process while increasing the yield rate.

In order to further appreciate the characteristics and technical contents of the instant disclosure, references are hereunder made to the detailed descriptions and appended drawings in connection with the instant disclosure. However, the appended drawings are merely shown for exemplary purposes, rather than being used to restrict the scope of the instant disclosure.

What is claimed is:

1. A magnet-less loudspeaker, comprising:

a ferrite core (1) having a main surface and a lateral surface;

a voice coil (2) wound around the ferrite core and cooperatively forming an exciting device; and a movable metallic membrane (3) disposed in close proximity to the exciting device, having a substantially plate body and at least one covering member (32), wherein the at least one covering member (32) is an arc-shaped projection extended from at least one lateral edge of the movable metallic membrane (3) and arranged in an intermittently circumscribing configuration along the lateral edge, such that the arc-shaped covering member (3) projects to conformingly overlap with respect to portions of the lateral surface of the ferrite core, wherein the movable metallic membrane and the exciting device cooperatively forming a gap there between.

2. The loudspeaker of claim 1, further comprising a connecting member abridging the movable membrane to the ferrite core.

3. The loudspeaker of claim 2, wherein one end of the connecting member is connected to the edge of the movable membrane, while the connecting member has substantially a bent shape and extends in fixing the other end thereof to the ferrite core.

4. The loudspeaker of claim 1, wherein the at least one covering member is disposed at the periphery of the exciting device.

5. The loudspeaker of claim 4, wherein the covering member has substantially a bent shape and extends from the edge of the movable membrane.

6. The loudspeaker of claim 1, wherein the ferrite core, the voice coil, and the movable membrane are enclosed by a housing.

7. The loudspeaker of claim 1, wherein the movable membrane is a metallic plate.

8. The loudspeaker of claim 1, wherein the movable membrane has substantially the same contour as the ferrite core.

9. The loudspeaker of claim 1, wherein the ferrite core is formed annularly and the movable membrane is circular plate-shaped.

10. The loudspeaker of claim 1, wherein the ferrite core is a rectangular block and the movable membrane is formed in a rectangular plate-like shape.

11. The loudspeaker of claim 1, wherein the movable membrane is a magnetically polarized material.

* * * * *